US011137113B2

(12) United States Patent
Skovholt

(10) Patent No.: US 11,137,113 B2
(45) Date of Patent: Oct. 5, 2021

(54) CRYOGENIC FLUID STORAGE TANK

(71) Applicant: IC Technology AS, Trondheim (NO)

(72) Inventor: Otto Skovholt, Trondheim (NO)

(73) Assignee: IC TECHNOLOGY AS, Trondheim (NO)

( * ) Notice: Subject to any disclaimer, the term of this patent is extended or adjusted under 35 U.S.C. 154(b) by 0 days.

(21) Appl. No.: 16/630,241

(22) PCT Filed: Jun. 29, 2018

(86) PCT No.: PCT/NO2018/050172
§ 371 (c)(1),
(2) Date: Jan. 10, 2020

(87) PCT Pub. No.: WO2019/027329
PCT Pub. Date: Feb. 7, 2019

(65) Prior Publication Data

US 2021/0095820 A1 Apr. 1, 2021

(30) Foreign Application Priority Data

Aug. 1, 2017 (NO) ..... 20171280

(51) Int. Cl.
*F17C 3/02* (2006.01)
*B63B 25/16* (2006.01)

(52) U.S. Cl.
CPC ..... *F17C 3/027* (2013.01); *B63B 25/16* (2013.01); *F17C 2201/052* (2013.01); *F17C 2203/0354* (2013.01); *F17C 2203/0358* (2013.01); *F17C 2209/232* (2013.01); *F17C 2221/033* (2013.01); *F17C 2223/0161* (2013.01); *F17C 2223/033* (2013.01); *F17C 2260/016* (2013.01); *F17C 2270/0107* (2013.01)

(58) Field of Classification Search
CPC .. F17C 3/00; F17C 3/027; F17C 13/00; F17C 13/08; F17C 13/081; F17C 13/082; F17C 13/083; B63B 25/00; B63B 25/08; B63B 25/16
USPC ..... 114/74 A
See application file for complete search history.

(56) References Cited

U.S. PATENT DOCUMENTS 4,116,150 A * 9/1978 McCown ..... B63B 25/16 114/74 A
4,170,952 A * 10/1979 McCown ..... B63B 25/16 114/74 A (Continued)

FOREIGN PATENT DOCUMENTS

CN 1288842 A 3/2001
CN 1772560 A 5/2006

(Continued)

OTHER PUBLICATIONS

NO Search Report mailed in NO 2017180 dated Feb. 28, 2018.

(Continued)

*Primary Examiner* — Lars A Olson
(74) *Attorney, Agent, or Firm* — Wissing Miller LLP

(57) ABSTRACT

A Liquid Natural Storage (LNG) tank comprising an outer mechanical support structure (20) providing a closed space housing a membrane wall of the cryogenic tank is disclosed. Spacer elements (21) is supporting a membrane wall constituted by a mixture of steel plates, steel rods, wooden beams and plywood plates.

10 Claims, 6 Drawing Sheets

(56) References Cited

U.S. PATENT DOCUMENTS

| | | | | |
|---|---|---|---|---|
| 6,374,761 | B1 | 4/2002 | Dhellemmes | |
| 7,464,658 | B2 | 12/2008 | Dhellemmes et al. | |
| 7,819,273 | B2 * | 10/2010 | Yang ..... | F17C 13/001 220/592.26 |
| 2007/0028823 | A1 | 2/2007 | Yang | |
| 2010/0083671 | A1 | 4/2010 | Liner | |
| 2017/0159888 | A1 | 6/2017 | Han | |

FOREIGN PATENT DOCUMENTS

| | | |
|---|---|---|
| EP | 1847758 | 10/2007 |
| WO | 2007064212 | 6/2007 |
| WO | 20080147003 | 12/2008 |
| WO | 20160046487 | 3/2016 |
| WO | 20170135826 | 8/2017 |

OTHER PUBLICATIONS

PCT Search Report mailed International Search PCT/N02018/050172 dated Oct. 18, 2018.
Chinese Office Action, Application No. CN201880050384.3, dated Apr. 6, 2021, 4 pages CN201880050384.4.
Chinese Search Report mailed in Application CN 201880050384.3, dated Mar. 22, 2021, 2 pages CN201880050384.4.

* cited by examiner

CRYOGENIC FLUID STORAGE TANK

CROSS-REFERENCE TO RELATED APPLICATIONS

This application is a 371 of PCT/NO2018/050172 filed on Jun. 29, 2018, published on Feb. 7, 2019 under publication number WO 2019/027329, which claims priority benefits from Norwegian Patent Application No. 20171280 filed Aug. 1, 2017, the disclosure of each is incorporated herein in their entirety by reference.

FIELD OF THE INVENTION

The present invention relates to a cryogenic fluid storage tank, and especially to a tank design comprising an outer support structure supporting at least two independently arranged concentric steel membranes inside the outer support structure.

BACKGROUND OF THE INVENTION

Natural gas is a major energy source used in many industrial processes as well as supplying energy to households. The supplying gas to respective consumers requires an infrastructure distributing gas from offshore gas fields as well as land-based fields. Enabling a balanced consumption of LNG in view of uneven production rates or distribution usually requires Liquid Natural Gas (LNG) storage tank facilities in between consumers and the supply from fields providing buffering of any variations in production rates or supply.

A major problem when transporting and storing natural gas is the volume of the gas. Therefore, the volume is generally reduced by cooling the natural gas converting the gas to a liquefied phase around −165° C. The liquid volume is then only about 1/600 of the starting gas volume. Liquefied natural gas (LNG) is therefore a preferred phase when transporting and storing natural gas.

The same technique is used when transporting and storing other types of cryogenic gasses like methane, ethylene, and propane etc. as known to a person skilled in the art.

As an example of a cryogenic gas, LNG is used as a non-limiting example of gas or fluid in the description.

Storage and transport of liquefied LNG is a technical challenge not only due to the low temperature, but also due to safety issues.

The cryogenic temperature associated with LNG systems creates a number of safety considerations regarding bulk transfer and storage. Most importantly, LNG is a fuel that requires intensive monitoring and control because of the constant heating of the fuel, which takes place due to the extreme temperature differential between ambient and LNG fuel temperatures. Even with highly insulated tanks, there will always be a continuous build-up of internal pressure and a need to use for example a fuel vapour vent thereby safely venting vapour to the surrounding atmosphere. When transferring LNG in pipes, it is necessary to cool down the transfer pipelines in order to avoid forming excessive amounts of vapour and hence an increased pressure inside the pipelines.

Another consideration is that at low temperatures, many materials may undergo changes in their strength making them potentially unsafe for their intended use. For example, materials such as carbon steel lose ductility at low temperatures, and materials such as rubber and some plastics have a drastically reduced ductility and impact strength such that they may shatter into pieces when dropped, or when being subject to other external impact forces.

The standard ISO 12991:2012 disclose safety regulations related to LNG storage tanks on trucks. The standard specifies construction requirements of refillable fuel tanks for liquefied natural gas (LNG) used on vehicles as well as providing testing methods required to ensure that a reasonable level of protection from loss of life and property resulting from fire and/or explosions.

The European standard EN 14620, 1-5 provides design guidelines for vertical cylindrical storage tanks with flat bottoms for storage of LNG. There are rules regarding material properties and testing, certification of materials, etc.

Ship designs transporting LNG are subject to strict safety requirements. Ships must be built according to ship classifications rules allowing the ships to transport LNG or other cryogenic fluids. The International Maritime Organisation (IMO) has created a set of classes and rules related to different cryogenic tank designs used on board ships for transportation of liquefied cryogenic gasses.

The French company GTT Technigaz has developed a range of LNG tank designs suitable for ships based on using a combination of plywood plates, corrugated steel plates and isolation materials. An example of their design in illustrated in FIG. 1.

The FIG. 1 and a more detailed description of the GTT technology is disclosed on the link http://www.gtt.fr/technologies-services/our-technologies/mark-v-system.

The main idea of the GTT design is to use walls of the ship hull as the supporting structure supporting an insulated leakage proof membrane. The tank wall is a sandwich construction of respective elements. The ship hull support directly plywood panels carrying an assembly of a first insulating layer supporting a layer with corrugated steel plates being welded together during assembly, followed by another insulating layer finalized with a second layer of corrugated steel plates being welded together during assembly of the GTT tank wall. The steel plates of the first and second layer are in direct contact with the insulating material. In order to provide sufficient surface contact between the steel plate surfaces and the insulating material the corrugations are located at the edges of the plates, and are shaped in a V like form around the square or rectangular flat shaped steel plates. The peak of the V shaped corrugation along one edge is then orthogonal to another V shaped edge along another adjacent edge, and all sides together forms a regular immersion with a flat bottom adapted to receive adapted insulating material elements. The V shaped edges are welded together thereby forming a section of the tank wall. The V shape is designed to mitigate effects of thermal induced stress in respective steel plates.

Transporting cryogenic gasses in liquefied state inside cryogenic transporting and storage tanks requires that the respective tank designs fulfil both national and international safety regulations.

The challenge when transporting liquefied cryogenic gasses on board a ship is the fact that bad weather may affect the mechanical integrity of the tank, which may lead to leakage of gas and a possible explosion.

When a ship is subject to harsh weather conditions, sloshing and wave oscillations inside the tank of the liquefied gas is known to provide effects of a magnitude onto the tank membranes that might break the barriers, and hence leakage and explosion may follow.

When transporting liquefied cryogenic gases on land, trucks supporting transport tanks can be subject to collisions, which may damage the tank.

When storing liquefied cryogenic gasses on land in storage tanks the storage tanks may be subject to buffeting from bad weather and/or geological phenomena.

The cryogenic temperature affects the materials as known in the prior art. Therefore, only specific steel qualities are allowed. For example, the steel quality 304 is common to use in steel membranes of cryogenic tanks providing beneficial properties with respect to mechanical integrity from impacts as well as low cryogenic temperatures.

Although LNG tank designs or cryogenic tank designs in general, in prior authorities certify art, there seems to be specific different designs available for different application areas of respective LNG or cryogenic tank designs. Despite the fact that any application area of for example LNG tanks faces many of the same technical challenges, LNG transport tanks on trucks are substantially different from vertical storage tanks on land, while LNG storage tanks on ships are different form the other designs of other application areas. Further, a major difference with respect to land based storage tanks is if the tank is an above ground Storage Tank (AST) or an Underground Storage Tank (UST).

Hence, an improved cryogenic storage tank design, especially a LNG storage tank, would be advantageous, that can be applied and adapted to different cryogenic liquid storage tank applications, and in particular, a more efficient and a simpler LNG storage tank design would be advantageous.

OBJECT OF THE INVENTION

It is a further object of the present invention to provide an alternative to the prior art.

In particular, it may be seen as an object of the present invention to provide

SUMMARY OF THE INVENTION

Thus, the above described object and several other objects are intended to be obtained in a first aspect of the invention by providing a The invention is particularly, but not exclusively, advantageous for obtaining a Respective aspects of the present invention may each be combined with any of the other aspects. These and other aspects of the invention will be apparent from and elucidated with reference to the embodiments described herein.

DESCRIPTION OF THE FIGURES

The cryogenic storage tank according to the present invention will now be described in more detail with reference to the accompanying figures. The attached figures illustrate an example of embodiment of the present invention and is not to be construed as being limiting to other possible embodiments falling within the scope of the attached claim set.

DETAILED DESCRIPTION OF AN EMBODIMENT

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Further, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The present invention uses combinations of materials comprising for example steel plates in membranes and wooden beams in respective support structures as well as plywood plates that also constitute parts of respective membranes.

Figure 1:
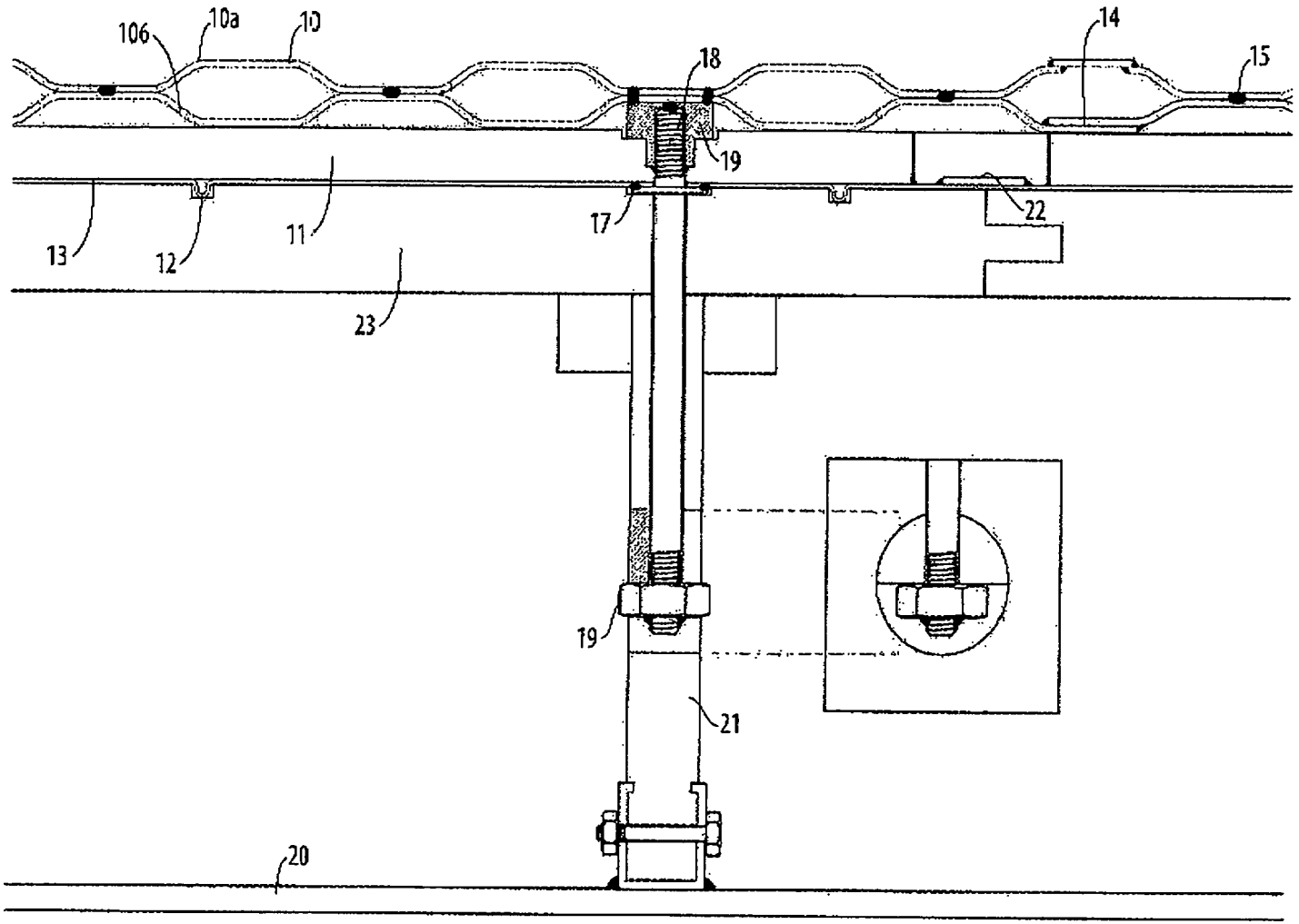
FIG. 1 illustrate an example of embodiment of the present invention.

FIG. 1 illustrates an example of embodiment of the present invention of a cryogenic tank wall wherein an inner double plated membrane 10 is supported by a plywood wall 11. FIG. 1 illustrates a section of the cryogenic wall. The illustrated wall section will stretch around the whole circumference of a cryogenic tank defining a sealed cryogenic tank.

The double plated membrane 10 comprises a first and second corrugated steel plate 10*a*, 10*b*. The corrugation pattern can be viewed as distributed bubbles over the surface of the membrane formed by indents on the first and second steel plate facing each other.

The indents on the first steel plate 10*a* is displaced horizontally relative to the indents of the second steel plate 10*b*. Then a "top" of the first steel plate 10*a* is located above a "valley" on the second steel plate 10*b*. Thereby, a repeated pattern of closed spaces is arranged in between the two steel plates.

The first steel plate 10*a* and the second steel plate 10*b* is welded to each other at respective welding points 15. The first steel plate 10*a* can be welded to further first steel plate adjacent to the first steel plate 10*a*. Likewise can the second steel plate 10*b* be welded to a further adjacent second steel plate. Then a double plated corrugated membrane can be made as indicated by the reference numeral 14.

In the example of embodiment illustrated in FIG. 1, there is also a further single plated steel membrane 13 supported by a further plywood wall 23. Corrugations 12 is arranged spaced apart on the single plated membrane 13. Space for the corrugation is arranged as an indent 12 on the surface of the supporting plywood plate 23 supporting the single plated membrane 13.

The single plated membrane is constituted by a plurality of single steel plates welded together as illustrated by the reference numeral 22. A joining cover 22 is welded across the joint between the respective adjacent steel plates. A space for the cover is arranged inside the plywood plate 11 supporting the double plated membrane 10.

Further plywood plates via tongue and grooves join the plywood plate 23.

Respective sections of the tank wall is attached to spacer elements 21 providing a space between the tank wall and an outer mechanical support structure 20. The outer mechanical support structure can be a ship hull or a concrete wall of a land based tank assembly. Other outer support structures can be container walls and similar objects.

A coupling element 19 is welded to the side of the double plated membrane facing towards the plywood wall 11. A spacer element 21 is attached to the coupling element, for example by a threaded coupling 18. The spacer element is further guided through the single plated membrane 13 and the plywood wall 23, and is connected to the outer mechanical support structure 20 via a hinged connection for example. The spacer element 21 is guided through the single plated membrane 13, wherein a joining cover 17 is welded to the single plated membrane 11 surface on all sides around the spacer element 21. The spacer element 21 pass through an adapted hole in the joining cover 17 and may be welded to the joining cover 17.

The spacer element 21 is a hybrid design comprising a steel bolt being connected to the coupling element 19 attached to the inner double plated membrane 10. At an opposite end closer to the mechanical support structure 20, the steel bolt is integrated inside a wooden beam for example. A nut 19 is arranged inside an accessible cavity in the wooden beam 21. When the nut 19 is tightened, the whole wall assembly is tightened together between the joining cover 17 and the coupling element 19 providing a leakage proof cryogenic tank wall.

Figure 2:
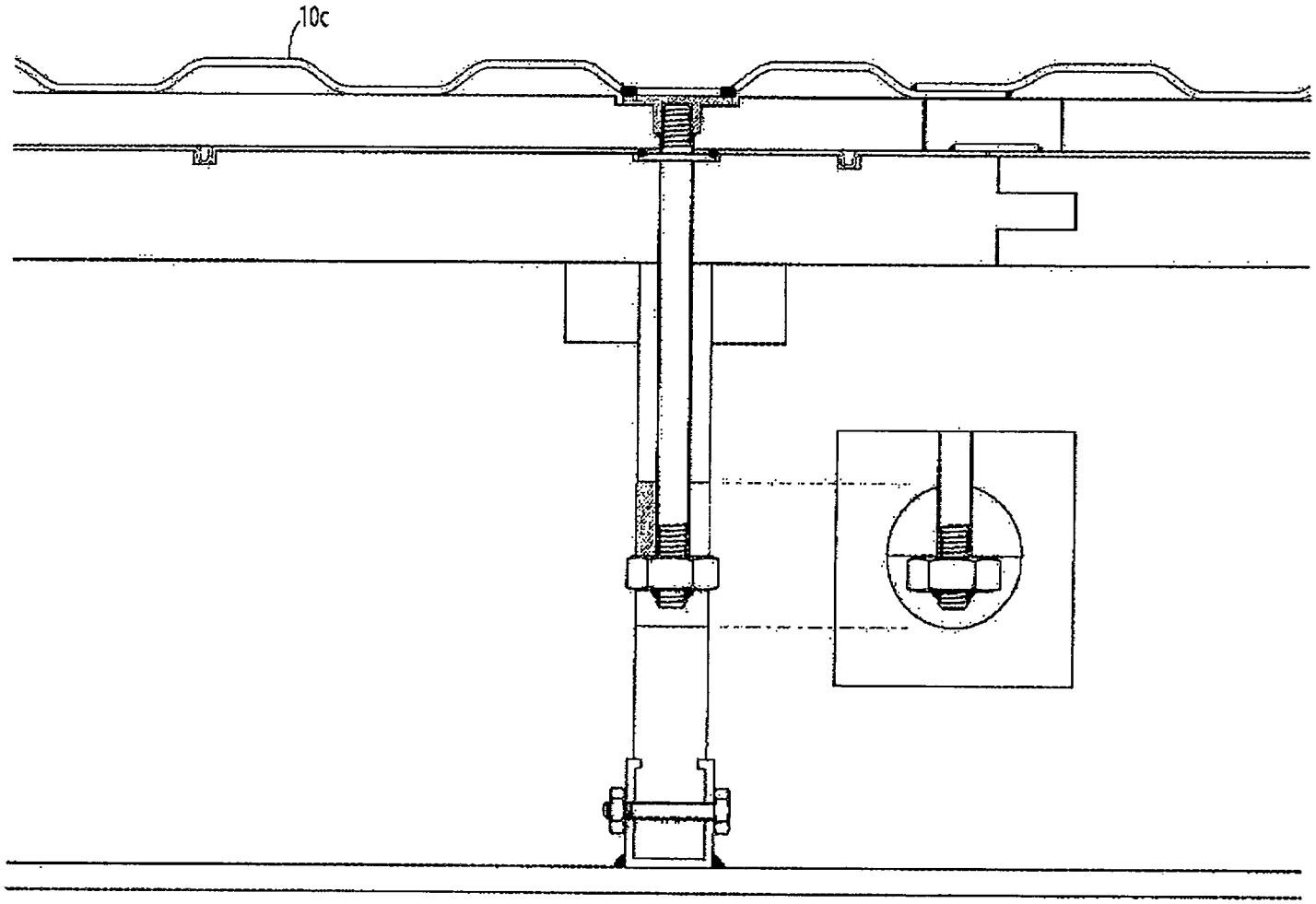
FIG. 2 illustrate another example of embodiment of the present invention.

FIG. 2 illustrates another example of embodiment of the present invention. The difference between this example of embodiment compared to the example illustrated in FIG. 1, is that the double plated membrane 10 is replaced by a single plated corrugated steel membrane 10*c*. The other details with respect to the spacer element etc. are the same. The single plated membrane 13 supported by the plywood plate 23 is also present.

Figure 3:
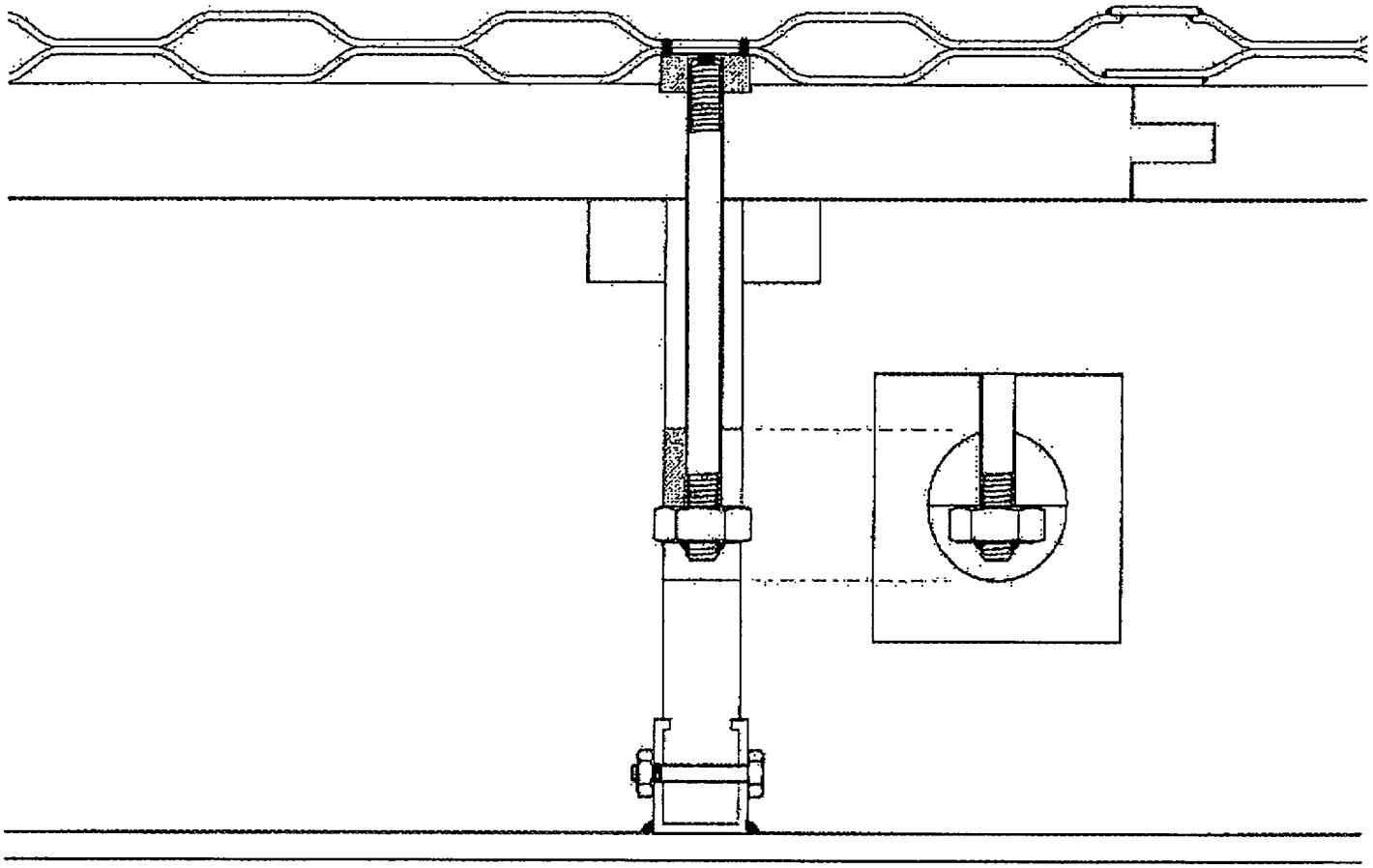
FIG. 3 illustrate another example of embodiment of the present invention.

FIG. 3 illustrate a further example of embodiment of the present invention comprising only a double plated corrugated membrane 10 as disclosed in the example illustrated in FIG. 1. In this example of embodiment, the single plated membrane 13 is removed. Consequently, only the plywood wall 23 is present in this example of embodiment. The spacer element etc. is the same as in the other examples of embodiment of the present invention.

Figure 4:
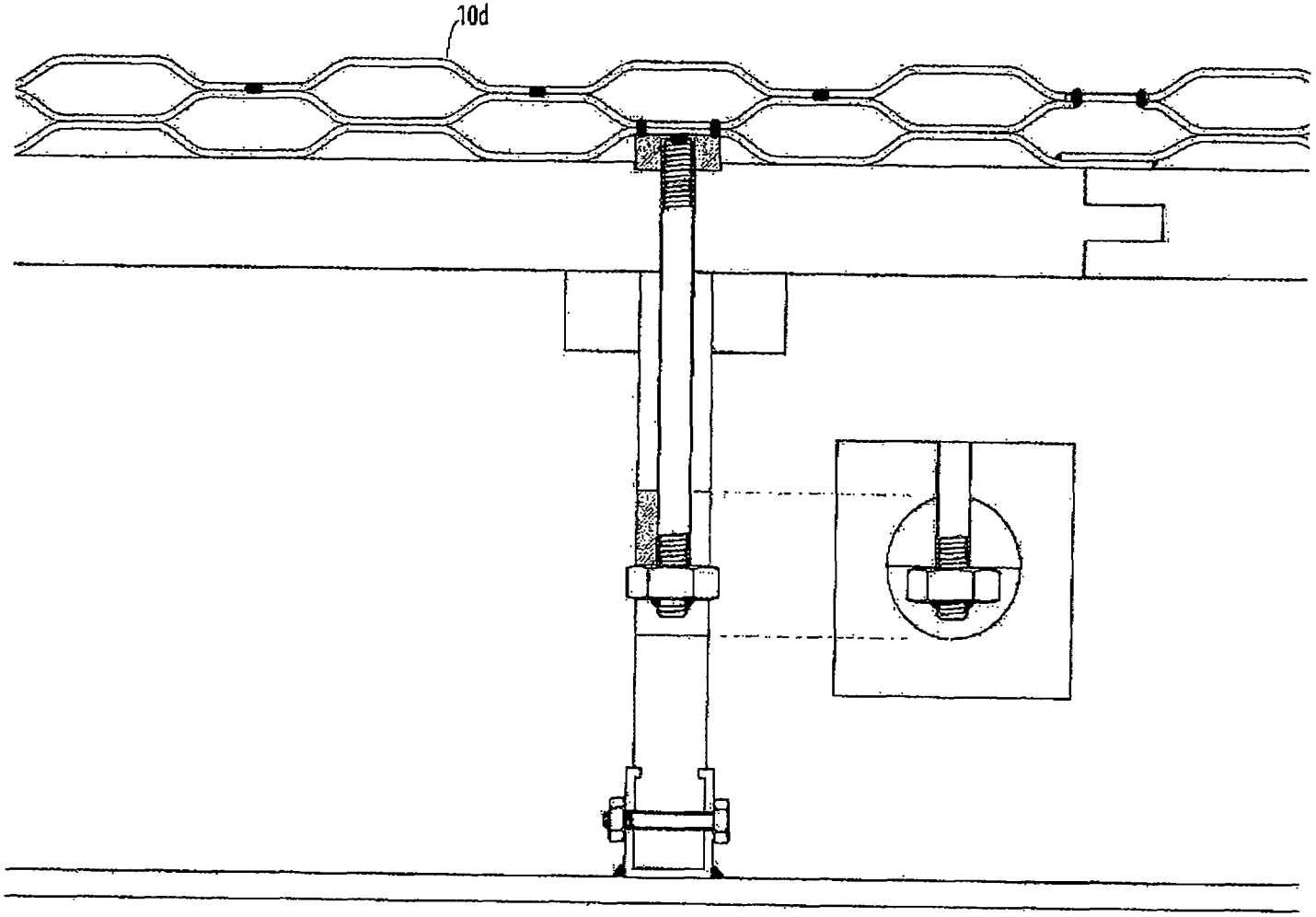
FIG. 4 illustrate another example of embodiment of the present invention.

FIG. 4 illustrates another example of embodiment wherein the double plated corrugated membrane 10 in the example illustrated FIG. 3 is replaced by a three plated membrane 10*d* comprising three joined corrugated membrane plates. When viewed in order from the inside of the tank, the first and second corrugated steel plate is arranged as in the example of embodiment disclosed in FIGS. 1 and 3. A first corrugated steel plate is displaced horizontally relative to a second corrugated steel plate defining "bubbles" as discussed above. A third corrugated steel plate is attached to the second steel plate also displaced horizontally relative to the first and second corrugated steel plate. Then there is a double set of "bubbles", one set of bubbles constituted in between the first and second corrugated steel plate, and a second set of "bubbles" in between the second and third corrugated steel plate.

Figure 5:
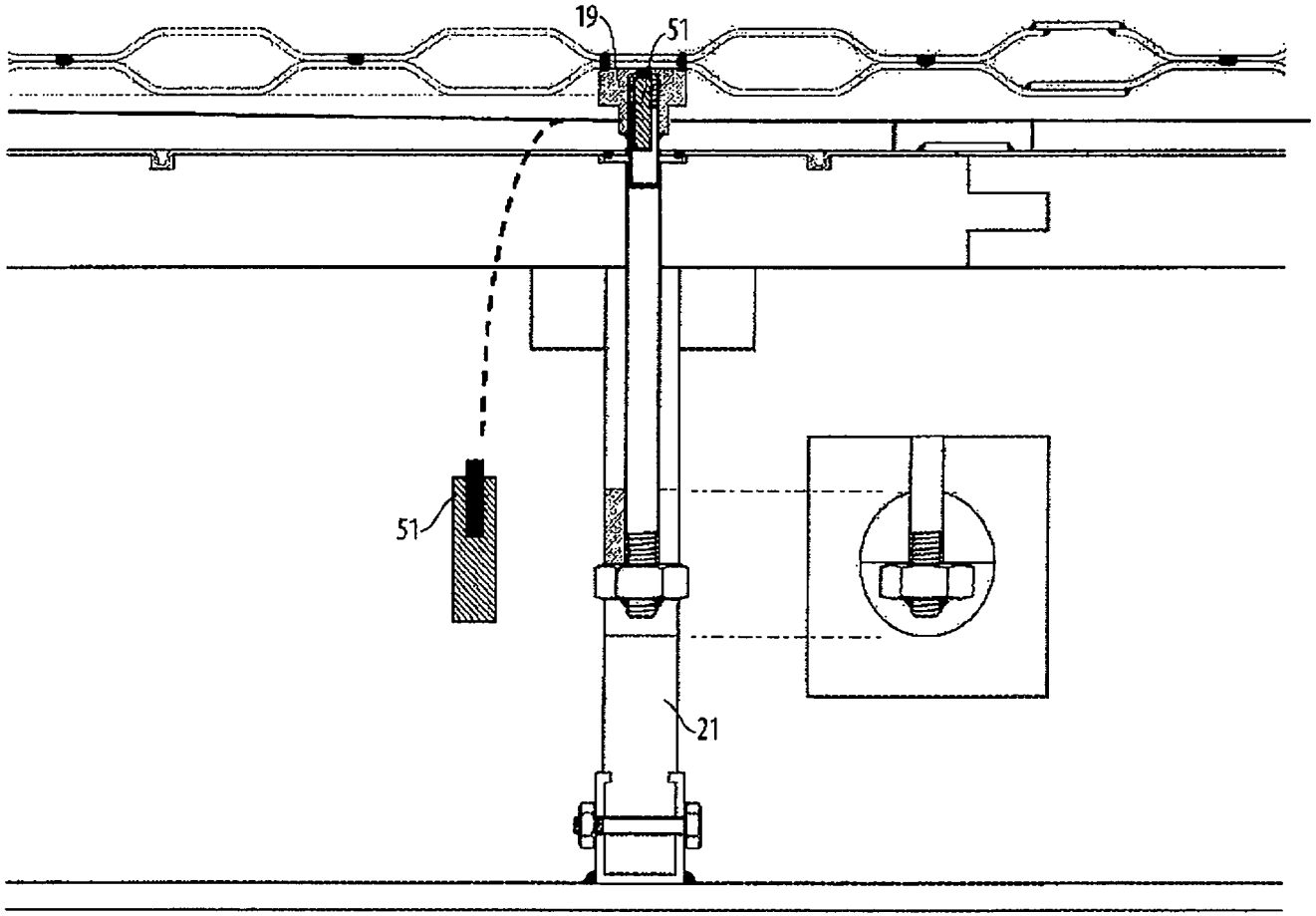
FIG. 5 illustrate another example of embodiment of the present invention.

FIG. 5 illustrate another example of embodiment according to the present invention. As an example, a same configuration as disclosed in FIG. 1 is used. In addition, FIG. 5 disclose the use of a shock absorber 51 in the coupling element 19 and the steel bolt of the hybrid spacer element 21. The shock absorber is of a magnetic/electrical type. A property of such shock absorbers is that when a shaft moves in and out of the shock absorber, the magnetic forces used to provide dampening of the shaft vary with the change of magnetic flux. When the movement is slow, there is minimal absorption in the shock absorber. When the movement is quick the absorber works. Another type of shock absorbers that can be used is based on a magneto rheological fluid, wherein the amount of absorption can be controlled or regulated.

When the cryogenic tank is at room temperature, i.e. there is no cryogenic fluid inside the tank and the membrane 10 will rest onto the plywood wall 11. When cryogenic fluid is filled inside the tank, the steel material of the membrane 10 will start to shrink. For example, if the tank has the shape of a cylinder, the diameter of the tank shrinks. The absolute amount of displacement of the walls is dependent on the actual size of the tank. Large tanks will have a larger absolute value of reduction in the diameter for example than a smaller tank. However, the movement is rather slow and the shaft of the absorber will follow the connected membrane movement inwards. If there is, a sudden slushing inside the tank the impact on the inner membrane will be taken up by the absorber. The impact force will be guided passed the other membranes and plywood panels into the outer mechanical support structure 20, for example, a ship hull. It also important to note that if for example a large wave hits the side of the ship hull, the shock absorber will minimize the transfer of forces onto the membranes and walls of the tank.

Figure 6:
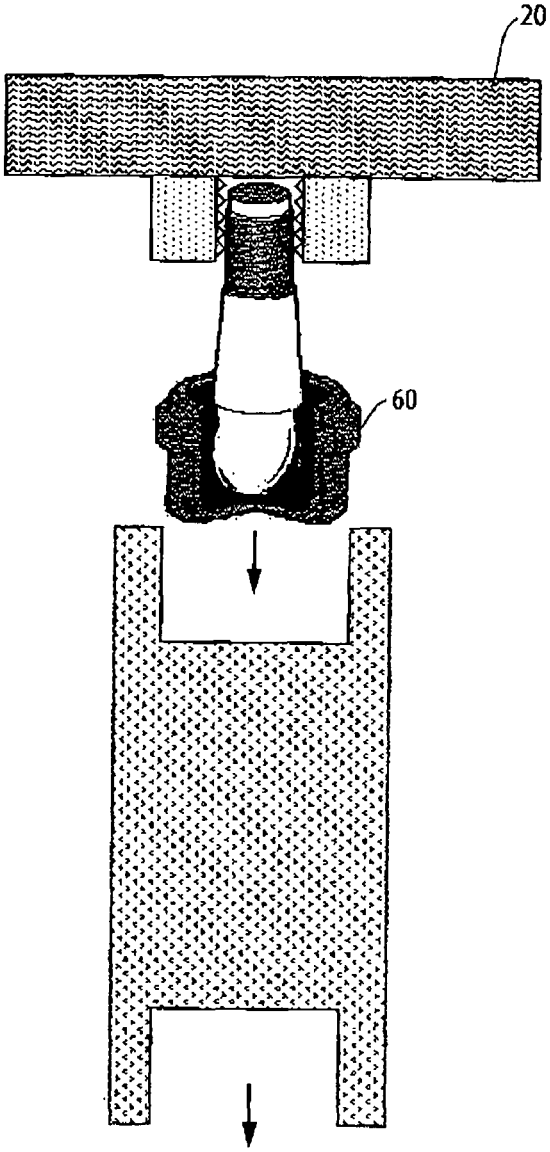
FIG. 6 illustrate another example of embodiment of the present invention.

FIG. 6 illustrate another example of embodiment of the present invention, The example illustrate the use of a ball joint 60 located between a spacer element 21 and the mechanical support structure 20. A same ball joint can be arranged closer or adjacent to the tank wall. The effect is that when the structure twist or move due to for example waves hitting a ship hull the transfer of the twisting forces to the spacer elements will be minimized thereby the integrity of the tank will be better protected.

An aspect of the present invention is that the strength of a LNG storage tank according to the present invention is controllable and achievable by the following features:

- The steel quality 304 provides a softness and steel quality that enables stretching off steel plates within known limits without the steel plates to be teared apart.
- The mechanical movements of steel plates due to thermal expansion and contractions are mitigated by corrugation elements provided on the respective steel plate surfaces of the membrane elements.
- The mechanical integrity of membrane elements can further be enhanced by increasing the number of fastening bolts attaching respective membrane elements to the wooden wall elements, to the spacer element or directly to the mechanical support structure.
- The area of the membrane surface between bolts are still enabled to mitigate thermal induced stress in the steel plates by corrugations in the surrounding of the respective fastening bolts.
- The wooden elements of the design is capable of withstanding twisting and stretching of the walls of the tank.
- The transfer of forces between the inner double plated membrane, the wooden wall elements and the mechanical support structure is controllable, and especially any transfer of forces between the wooden wall elements and inner double plated membrane elements can be eliminated, or at least be reduced significantly.
- Use of shock absorbers in spacer elements connected to an outer mechanical support structure.

Use ball joints in spacer elements between the tank wall and an outer mechanical support structure.

The invention claimed is:

1. A Liquid Natural Gas (LNG) storage tank comprising an outer mechanical support structure providing a closed space housing a membrane wall of a cryogenic tank, wherein the membrane wall is constituted by at least the following constructional elements in order from the inner surface side of the outer mechanical support structure toward the interior storage space of the LNG storage tank:

a spacer element connected in one end to the inner surface of the mechanical support structure;

a first plywood wall;

a single plated corrugated steel membrane supported by the first plywood wall;

a second plywood wall; and a double plated membrane supported by the second plywood wall comprising a first corrugated steel plate welded to a second corrugated steel plate;

wherein the corrugations on the first corrugated steel plate is sideways displaced relative to the second steel plate, thereby a pattern of distributed bubbles is arranged over the surface of the double plated membrane;

wherein the a steel rod integrated with the spacer element is connected to the double plated membrane in one end while the other end of the steel rod is attached to a nut accessible via an opening on a side face of the spacer element.

2. The storage tank according to claim 1, wherein the steel rod of the spacer element is guided through an adapted hole in joining plate, wherein the joining plate is welded to the single plated membrane on all sides around the steel rod of the spacer element.

3. The storage tank according to claim 1, wherein corrugations on the surface of the single plated membrane is fitted into adapted cutouts on the surface of the first plywood plate.

4. The storage tank according to claim 1, wherein a plurality of adjacent located plywood plates are connected together via tongue and groove connections.

5. The storage tank according to claim 1, wherein the double plated membrane is replaced by a single plated corrugated steel membrane.

6. The storage tank according to claim 1, wherein the single plated membrane supported by the first plywood plate is omitted.

7. The storage tank according to claim 6, wherein the double plated membrane is replaced by a three-layer membrane comprising three connected corrugated steel plates.

8. The storage tank according to claim 1, wherein a shock absorber is arranged between the steel membrane facing towards the inner space of the tank and a connected spacer element.

9. The storage tank according to claim 1, wherein ball joints are connected at least in one end of a spacer element.

10. The storage tank according to claim 1, wherein a hinge is arranged between a spacer element and an inner wall of the mechanical support structure.

* * * * *